US006656056B1

(12) United States Patent
Leonard

(10) Patent No.: US 6,656,056 B1
(45) Date of Patent: Dec. 2, 2003

(54) WRIST LOCKING GOLF TRAINING DEVICE

(76) Inventor: Christopher Leonard, 119 Country Club La., Pelham, NY (US) 10803

( * ) Notice: Subject to any disclaimer, the term of this patent is extended or adjusted under 35 U.S.C. 154(b) by 0 days.

(21) Appl. No.: 10/151,845

(22) Filed: May 21, 2002

(51) Int. Cl.[7] ..... A63B 69/36
(52) U.S. Cl. ..... 473/227; 473/212; 473/276
(58) Field of Search ..... 473/213, 212, 473/207, 226, 276, 275, 227

(56) References Cited

U.S. PATENT DOCUMENTS

| | | | | | |
|---|---|---|---|---|---|
| 2,273,416 | A | * | 2/1942 | Norwood | 473/206 |
| 3,423,095 | A | * | 1/1969 | Cox | 473/213 |
| 3,951,416 | A | * | 4/1976 | Koch et al. | 473/212 |
| 4,023,812 | A | * | 5/1977 | Lorang | 473/227 |
| 4,145,054 | A | * | 3/1979 | Stewart | 473/227 |
| 4,170,356 | A | * | 10/1979 | Banks | 473/227 |
| 4,210,334 | A | * | 7/1980 | Lind | 473/282 |
| 4,241,922 | A | | 12/1980 | Elliot | 273/189 |
| 4,245,841 | A | * | 1/1981 | Owens, Jr. | 473/212 |
| 4,781,382 | A | * | 11/1988 | Hargraves | 473/227 |
| 4,944,516 | A | | 7/1990 | Bickler | 273/183 |
| 5,174,575 | A | | 12/1992 | Leith | 273/187.2 |
| 5,203,568 | A | * | 4/1993 | Vasquez | 473/212 |
| 5,257,782 | A | * | 11/1993 | Schicketanz | 473/551 |
| 5,320,354 | A | * | 6/1994 | Vasquez | 473/213 |
| 5,470,073 | A | * | 11/1995 | Vasquez | 473/206 |
| 5,501,464 | A | | 3/1996 | Dalbo | 273/187.2 |
| 5,520,392 | A | | 5/1996 | Foresi | 473/227 |
| 5,772,523 | A | | 6/1998 | Sheftic | 473/227 |
| 5,846,143 | A | * | 12/1998 | Brock et al. | 473/409 |
| 5,865,685 | A | | 2/1999 | Thomas | 473/213 |
| 5,904,624 | A | * | 5/1999 | Martinez | 473/212 |
| 5,976,024 | A | * | 11/1999 | Marshall, Jr. | 473/227 |
| 6,004,221 | A | | 12/1999 | Thornhill | 473/227 |
| 6,251,025 | B1 | * | 6/2001 | Brock et al. | 473/227 |
| 6,491,591 | B1 | * | 12/2002 | Schuster | 473/212 |

* cited by examiner

*Primary Examiner*—Stephen Blau
*Assistant Examiner*—Nini F. Legesse
(74) *Attorney, Agent, or Firm*—Goldstein & Lavas, P.C.

(57) ABSTRACT

A golf training system for training a golfer to swing a golf club using his/her shoulders rather than wrists, by using a device having a sleeve for attaching onto the golf club and a stop arm pivotally attached to and extending from the sleeve. The golf club has a handgrip and the sleeve has a sleeve bore for extending over the handgrip and tightening thereon. A stop arm has a maximum upward angle which is adjustable with an adjustment mechanism. When the golfer grasps the golf club with a leading arm, the leading arm wrist is prevented from moving by the stop arm engaging the leading arm forearm. When the golf club is grasped with the hand of the trailing arm, the trailing arm wrist is also prevented from pivoting. Accordingly, the golfer has no choice but to use his/her shoulders to execute a swing.

8 Claims, 5 Drawing Sheets

WRIST LOCKING GOLF TRAINING DEVICE

BACKGROUND OF THE INVENTION

The invention relates to a wrist locking golf training device. More particularly, the invention pertains to a device which attaches onto a golf club handle such that as the golfer grasps the handle, the leading forearm is effectively engaged to lock both wrists, forcing the golfer to learn to execute the putting stroke using the shoulders.

It is often said that golf is simultaneously the most enjoyable and most frustrating game. To maximize the enjoyment and minimize the frustration, golfers seek to improve their skill by any means necessary. Accordingly, numerous teaching techniques and devices have been devised which seek to improve the skills of the fledgling golfer. In particular, many of the these focus particularly on the golf swing.

Most pros agree that one of the most critical factors in being successful in the game of golf is maintaining proper form. However, "proper form" often requires that the body act contrary to its prior conditioning, and even contrary to common sense. Accordingly, to achieve proper form, the body must be trained to act in a certain way, through repetition, concentration, and consistent correction. Since training which reinforces a poor habit is clearly counterproductive, it is desirable to correct the golfers form continuously throughout any golf training exercises.

Golf coaches will continuously correct the form of even a pro golfer while observing them practicing. However, not all bad habits are noticed by the coach, and can even occur to quickly to be seen at all. For these habits, it is desirable to use training aids which seek to ensure the golfer's compliance with proper form.

Over the years, numerous devices have been promulgated by various inventors as an attempt to overcome that inventor's concept of the biggest problem facing a golfer. In particular, U.S. Pat. No. 6,004,221 to Thornhill discloses a device which has a pair of arms which extend from the center of a putter, and which lightly contact the outside if the forearms to provide feedback to the golfer regarding the swing.

U.S. Pat. No. 4,241,922 to Elliot, Jr. discloses a golf training aid which includes a sleeve which fully encloses the forearm and wrist in an attempt to immobilize the same. U.S. Pat. No. 5,865,685 to Thomas discloses a golf swing improvement device. In particular, the device has a pair of wrist encircling members which seek to maintain the relative positioning of the wrists. U.S. Pat. No. 5,501,464 Dablo discloses a golf swing forearm/wrist positioner. Dablo seeks to immobilize both forearms by providing a V-shaped device which extends between and against both forearms.

U.S. Pat. No. 5,772,523 to Sheftic discloses a golf training device which includes a body contacting arm which extends from the proximal end of the golf club. The body contacting arm then contacting arm then extends toward the hip of the golfer. When the ball is properly addressed, the contacting arm moves adjacent to, but does not contact the hip of the golfer. Accordingly, Sheftic seeks to train the golfer to lock the leading arm—making Sheftic perhaps useful for training a golfer in driving, but not suitable for training a golfer to maintain proper form while putting U.S. Pat. No. 5,520,392 to Foresi et al. discloses a golf training device for teaching a pendulum-type putting swing. In particular, Foresi includes a rigid elongated member which attaches to the shaft of the golf club below the grip. The elongated member includes a bend to avoid contact with the hands of the user and then extends upwards all the way to the armpit of the golfer.

The present invention seeks to improve the golfer's swing by engaging the wrist whenever the club is grasped, to train the golfer to use his/her shoulders when putting. The system is particularly suited for use with a putter, and with training the proper form for putting. Accordingly, while these other units may be suitable for the particular purpose employed, or for general use, they would not be as suitable for the purposes of the present invention as disclosed hereafter.

SUMMARY OF THE INVENTION

It is an object of the invention to produce a golf training device that effectively trains a golfer to swing a putter using the shoulders by preventing the golfer from moving the wrists. Accordingly, the system engages the leading forearm and prevents the golfer from varying an angle of the leading forearm by immobilizing the leading wrist.

It is another object of the invention to provide a golf training device that prevents the golf club from pivoting the club between either the leading or trailing wrists. Accordingly, the device employs a stop arm which engages and immobilizes the leading forearm. Unexpectedly by locking the relative angle between the leading forearm and the golf club, the golfer cannot even "break" (pivot) the trailing wrist. Accordingly, the putting stroke only be swung by using the shoulders.

It is a further object of the invention to provide a golf training device that is adjustable for different golfers, having different hand positioning preferences, wrist flexibility, and right or left handed preferences. Accordingly, the device is positionable at any height desired on the club handgrip, is adjustable in maximum upward angle so as to effectively yet comfortably lock the wrist, and can be simply rotated around the handgrip to accommodate either a right handed or a left handed golfer.

It is a still further object of the invention to provide a golf training device that is comfortable for use. Accordingly, the stop arm is contoured to match the curvature or contours of the golfer's forearm inner surface, so as to engage the leading forearm with maximum surface area whereas the immobilizing force of the stop arm is effectively and comfortably distributed on the leading forearm of the golfer.

It is yet a further object of the invention that the device is suitable for use during everyday play. Accordingly, the device flips downward for storage so that it can remain attached on the handgrip of the club even when the club is inserted in the golf bag. A downward locking mechanism can prevent the stop arm from inadvertently flipping upward as the club is withdrawn from the golf bag, or from becoming snagged on other clubs.

The invention is a golf training system for training a golfer to swing a golf club using his/her shoulders rather than wrists, by using a device having a sleeve for attaching onto the golf club and a stop arm pivotally attached to and extending from the sleeve. The golf club has a handgrip and the sleeve has a sleeve bore for extending over the handgrip and tightening thereon. A stop arm has a maximum upward angle which is adjustable with an adjustment mechanism. When the golfer grasps the golf club with a leading arm, the leading arm wrist is prevented from moving by the stop arm engaging the leading arm forearm. When the golf club is grasped with the hand of the trailing arm, the trailing arm wrist is also prevented from pivoting. Accordingly, the golfer has no choice but to use his/her shoulders to execute a swing.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

FIG. 1 further illustrates the stop arm adjusted such that the maximum upward angle is a high angle.

DETAILED DESCRIPTION OF THE PREFERRED EMBODIMENTS

Figure 1:
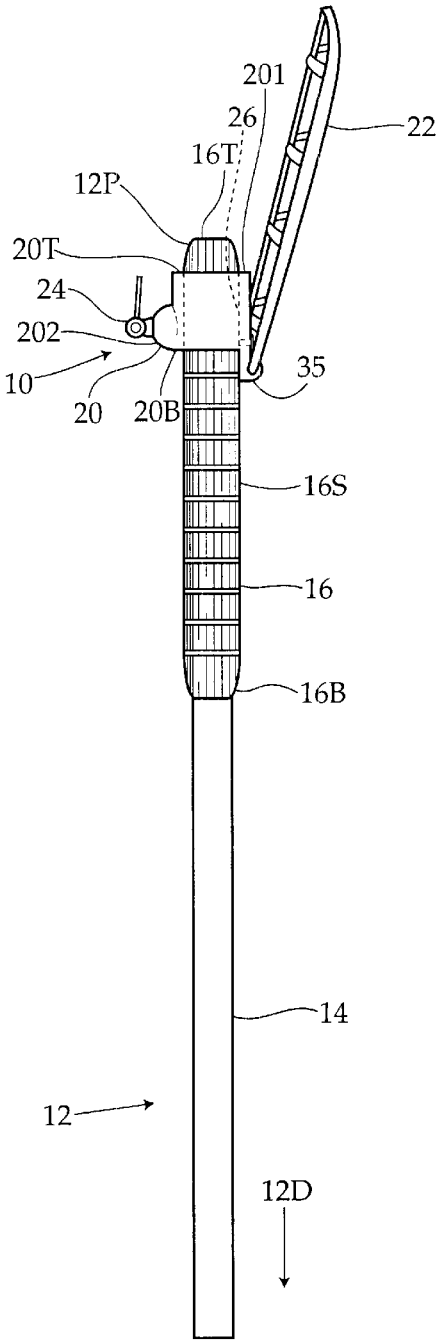
FIG. 1 is a front elevational view, illustrating the golf training device installed on the handgrip of a golf club.

FIG. 1 illustrates a golf training device 10 attached onto a golf club 12. The golf club 12 has a proximal end 12P and a distal end fully opposite therefrom, having a golf club head (not shown). The golf club 12 includes a shaft 14, which is generally made of metal or a composite material, and a handgrip 16 which extends over the shaft 14 near the proximal end 12P. The handgrip 16 has a handgrip top 16T, a handgrip bottom 16B, and a handgrip sidewall 16S. The golf club 12 as defined herein is typically a putter, as the present invention is best suited for training proper form during putting. However, the "golf club" 12 as defined herein need not be limited to a putter.

Figure 5:
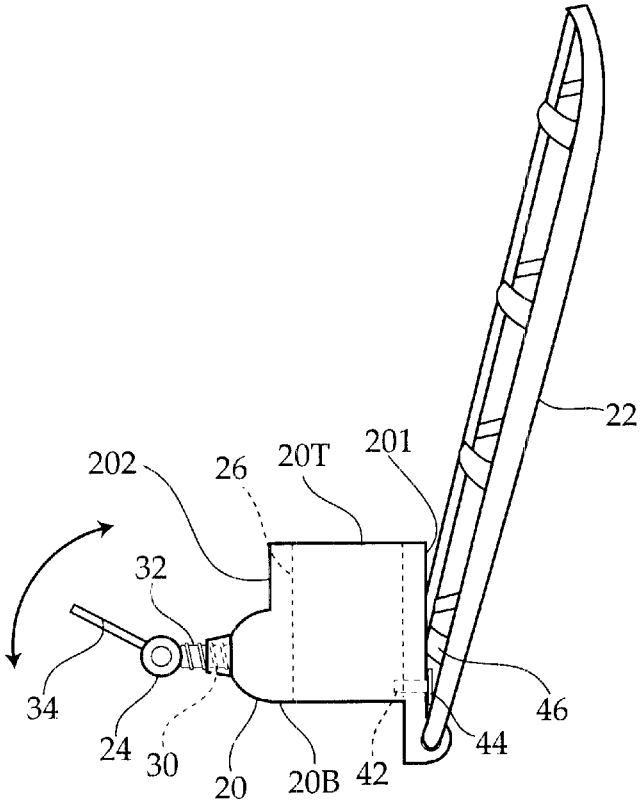
FIG. 5 is a front elevational view of just the golf training device, illustrating internal details which facilitate the attachment onto the golf club, securement onto the golf club, and adjustment of the stop arm.

As seen in FIG. 1 and FIG. 5, the training device 10 includes a sleeve 20, a stop arm 22 pivotally mounted to the sleeve 20 and a tightening mechanism 24. The sleeve 20 has a sleeve top 20T, a sleeve bottom 20B, a sleeve first side 201 and a sleeve second side 202. The sleeve 20 further has a substantially cylindrical sleeve bore 26 which allows the handgrip to extend through the sleeve 20 to facilitate attachment of the device 10 onto the handgrip 16. The sleeve bore 26 is generously sized, having a diameter which allows the sleeve 20 to be inserted onto handgrips 16 of varying sizes to accordingly allow the device 10 to be used on golf clubs. Because of the generous sizing of the sleeve 20, the tightening mechanism 24 is adjustable to extend within the sleeve bore 26 and engage the handgrip 16 and tighten thereagainst.

FIG. 5 illustrates one embodiment of the tightening mechanism 24. According to this embodiment, the tightening mechanism 24 includes a tightening bore 30 extending transversely through the sleeve second side 202 into the sleeve bore 26, a tightening screw 32 extending through the tightening bore 30, and a tightening handle 34 pivotally attached to the tightening screw 32. The tightening handle 34 may be used to cause the tightening screw 32 to rotate axially so that the tightening screw 32 advances into the tightening bore 30 and further into the sleeve bore 26, thus engaging and tightening against the handgrip side wall 16S, to secure the device 10 to the handgrip. The tightening handle 34 may be pivoted upward or downward as illustrated in FIG. 5 to that it is kept out of the way during usage of the device 10 and the golf club 12 upon which it is mounted.

However, the tightening mechanism can be configured in numerous other ways beyond the scope of the present discussion as would be appreciated by those skilled in the art of the invention. For example, the sleeve 20 may have a vertical split creating a gap fully through the sleeve second side 202 into the sleeve bore 26. Accordingly, the sleeve bore 26 and thus the sleeve 20 could flex, opening or closing the gap to accommodate various diameter handgrips. The tightening mechanism could then comprise a pair of clamping plates on either side of the split with a transverse screw extending between such plates which can be tightened to selectively narrow or expand the vertical split to suitably tighten the bore 26 against the handgrip.

Figure 2:
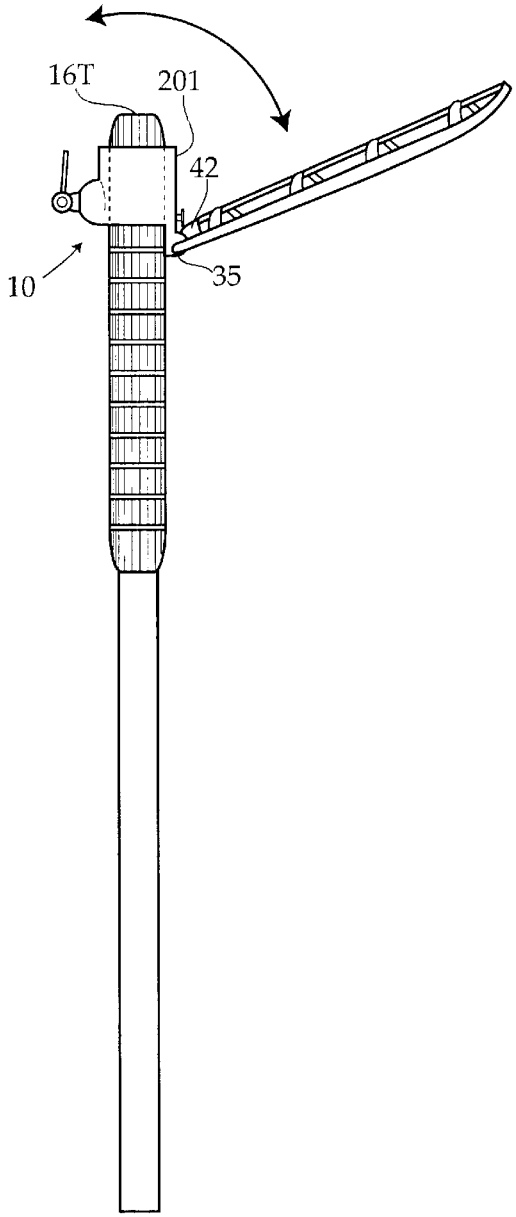
FIG. 2 is a front elevational view, similar to FIG. 1, except wherein the stop arm has been adjusted so that the maximum upward angle is a low angle, and further illustrating the pivotability of the stop arm.
Figure 3:
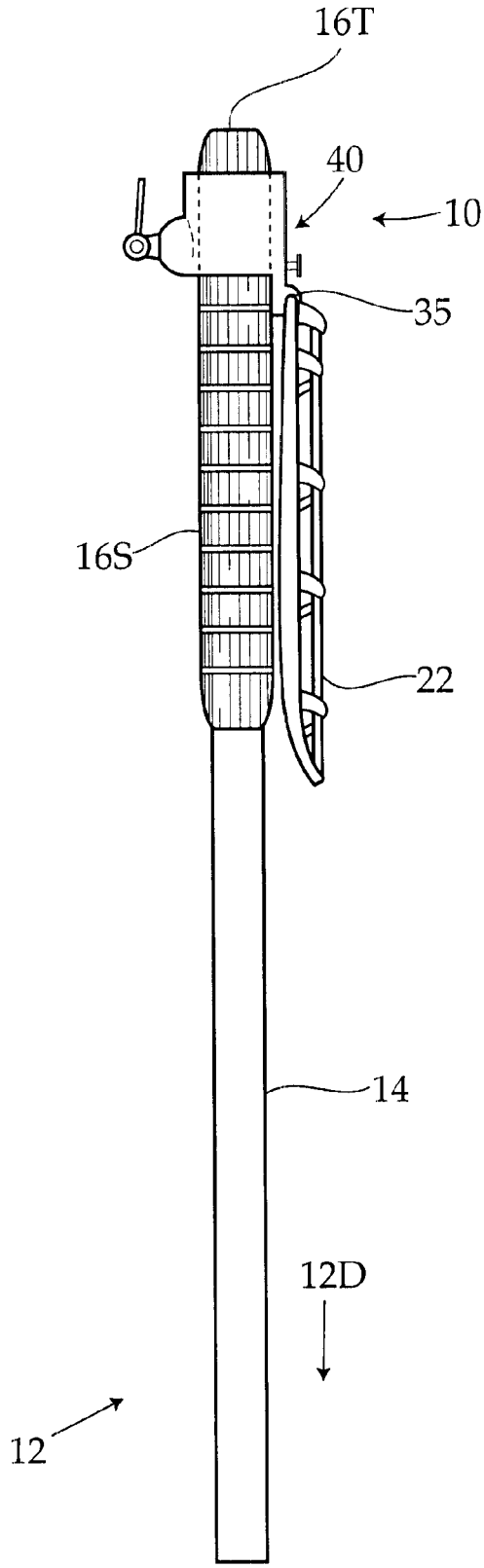
FIG. 3 is a front elevational view, wherein the stop arm is in the downward, storage position.

Note that in FIG. 1, FIG. 2, and FIG. 3, the device 10 is positioned near the handgrip top 16T. However, the device 10 may be positioned anywhere along the handgrip 16, between the handgrip top 16T and handgrip bottom 16B, as desired by the user. In this regard, the device 10 is positioned slightly lower on the handgrip 16 in FIG. 7.

Now that the training device 10 has been suitably positioned on the golf club 12, further description of the structure and functionality of the stop arm 22 is warranted. In particular, the stop-arm 22 is a rigid structure which is pivotally attached at a hinge axis 35, located at the sleeve first side 201 near the sleeve bottom 20B. Such pivotal attachment allows the stop arm 22 to pivot between a position wherein it extends vertically upward from and almost parallel to the shaft 14 of the club 12 and a downward position wherein the stop arm 22 extends substantially downward along the handgrip side wall 16S and shaft 14 toward the distal end 12D of the club 12 as seen in FIG. 3. Note however, certain structure of the device 10, including that of both the stop arm 22 and the sleeve 20 provide practical limits to the range of motion of the stop arm 22, such that it has a maximum upward angle shown in FIG. 1, 2, 4, or 5. The maximum upward angle is adjustable to accommodate the particular user of the golf training device 10.

Figure 4:
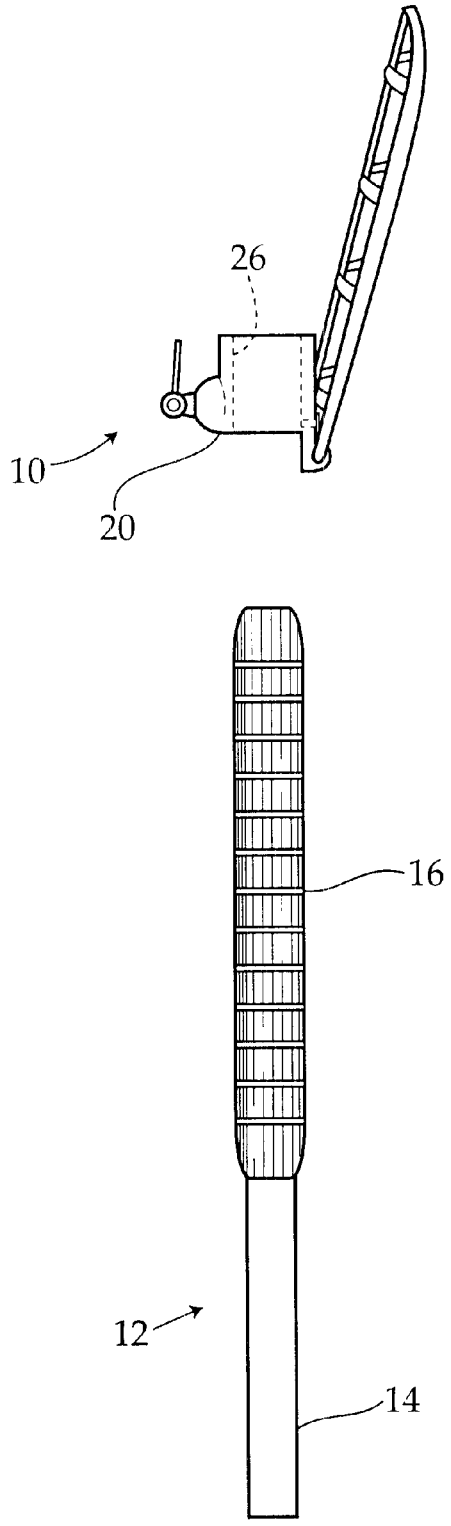
FIG. 4 is an exploded view, illustrating the removability and attachability of the training device onto the handgrip of the golf club.

In particular, an angle setting mechanism 40 (FIG. 3) limits the upward pivoting and thus the maximum upward or high angle positioning of the stop arm 22. The angle setting mechanism 40 allows the maximum upward angle to be set according to the preference of the user to facilitate the accomplishment of the training purposes which are disclosed in further detail hereinbelow. In the embodiment illustrated, the angle setting mechanism 40 comprises a simple set screw 42 which extends transversely through the sleeve 20 at the sleeve first side 201, just above the hinge axis 35. As seen in FIG. 5, the set screw 42 includes a contact point 44. The stop arm 22 includes a contact bar 46 which extends transversely across the stop arm 22 near the hinge axis 35. When the stop arm 22 is in its maximum upward position, its contact bar 46 engages the contact point 44 of the set screw 42. Accordingly, the more the set screw 42 protrudes from the sleeve 20, the more readily the contact point 44 thereof prevents the upward movement of the stop arm 22. Thus, referring to FIG. 2, where the set screw 42 extends significantly outward from the sleeve first side 201 of the sleeve 22, the maximum upward angle is a relatively low angle. However, when the set screw 42 is fully withdrawn or retracted into the sleeve 22, the contact point 44 presents little interference with the stop arm 22 achieving a high maximum upward angle, as seen in FIG. 1, FIG. 4, and FIG. 5.

Figure 6:
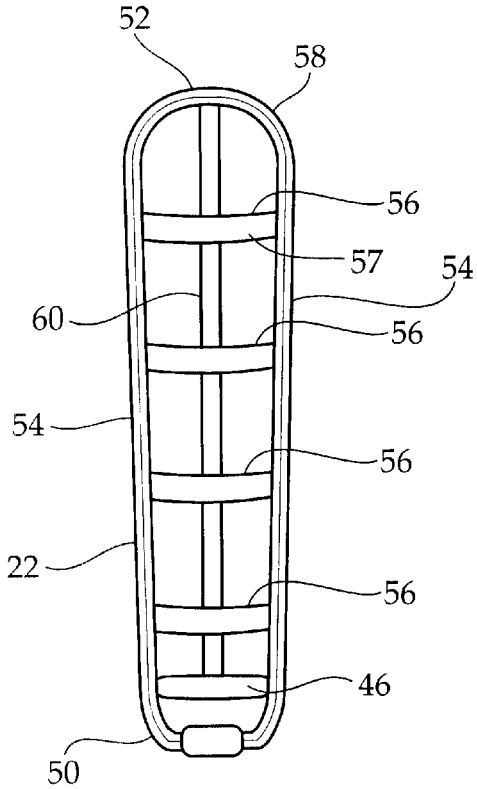
FIG. 6 is a side elevational view of just the stop arm.
Figure 7:
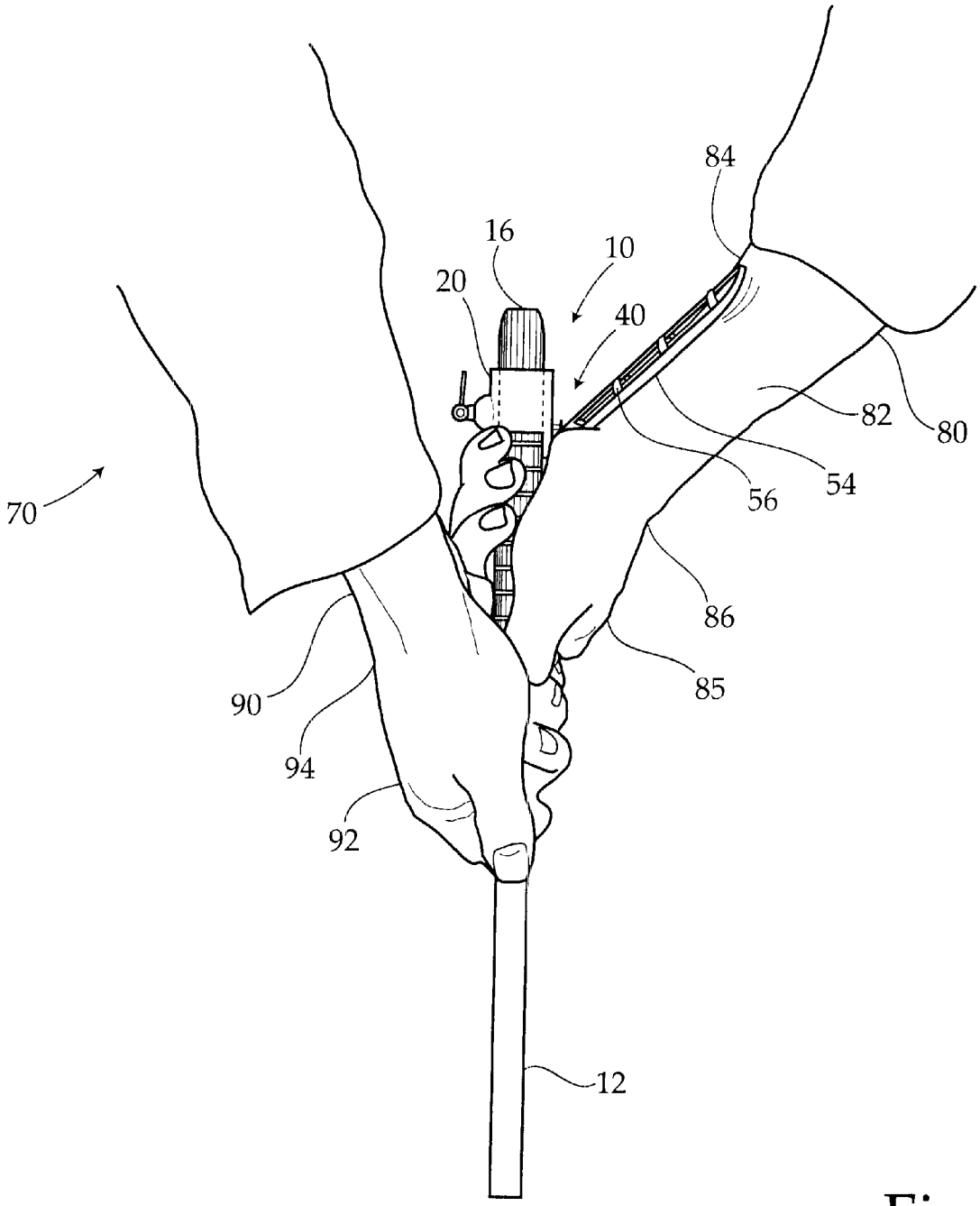
FIG. 7 is a front elevational view, illustrating a golfer grasping the club having the training device mounted thereon, wherein the leading arm is engaged by the stop arm.

FIG. 6 illustrates just the stop arm 22, having a pivot bar 50 which engages the sleeve 20 and pivots thereat. Fully opposite from the pivot bar 50 is a stop arm end 52. By the preferred structure illustrated in FIG. 6, the stop arm 22 comprises rod-like side rails 54, which are connected by a plurality of concave cross bars 56. Referring momentarily to FIG. 7, a golfer 70 has a leading arm 80 having a leading arm forearm 82 having a leading arm forearm inner surface 84, having a curved contour. As seen in FIG. 7, the side rails 54 and concave cross bars 56 are positioned so as to meet the curved contour of the leading arm forearm inner surface 84. In this regard the stop arm is generally constructed of rigid yet soft materials, or is padded to maximize the comfort of the user. The stop arm 22 may also be made of a continuous unitary piece, having a generally elongated configuration, with a longitudinal concave hollow (perhaps resembling a shoe horn) which comfortably accommodates the leading arm forearm inner surface 84. The general longitudinal concave hollow also facilitates storage of the club with the device 10 attached thereon. Referring to FIG. 3, the stop arm 22 has been pivoted fully downward, wherein it is nearly parallel to the club. The longitudinal concave hollow of the stop arm 22 helps the stop arm 22 conform relatively closely to the shaft 14 of the club 12. With regard to storage of the club, it is contemplated that a downward locking mechanism be provided to help maintain the stop arm 22 in the downward position when it is being stored, to prevent it from being inadvertently "flipped upward" when it is withdrawn from a golf bag and wedging therein, and to also prevent it from snagging on other clubs as they are withdrawn from the golf bag. Such a downward locking mechanism may be configured in numerous ways, and is accordingly beyond the scope of the present discussion.

Still referring to FIG. 6, the stop arm 22 may be configured wherein the side rails 54 are made both made of one continuous piece of a rod-like material, bent at the stop arm end 52 to form a curved return 58. In addition, as each of the concave cross bars 56 would naturally have a peak 57 (which might also be considered a "valley"), a reinforcement bar 60 can connect the peaks 57 of all of the concave cross bars 56, extending parallel to the side rails 54 and centered therebetween, extending from the stop arm end 52 to the contact bar 46. The pivot bar 50 may simply comprise a pair of facing right angle bends in the side rails 54, fully opposite from the stop arm end 52, which engage a pair of simple coaxial holes on opposite sides of the sleeve 20 at the hinge axis 35.

Now that the structure of the training device 10 has been established, both in a broad sense and with specific details which should be regarded as exemplative of the numerous variations possible, discussion of the functionality of the device in furtherance of the goals of the invention is now appropriate. In particular, FIG. 7 illustrates the golfer 70 grasping the golf club 12. In addition to the leading arm 80, the golfer has a trailing arm 90. The leading arm 80 has a leading arm hand 85 and a leading arm wrist 86. The trailing arm 90 has a trailing arm hand 92 and a trailing arm wrist 94. In typical putting style, the golfer 12 is grasping the golf club 12 with the leading arm hand 85 grasping the handgrip 16 above the trailing arm hand 92. The leading arm hand 85 is located just below the sleeve 20

In accordance with the present invention, the leading arm forearm 82 is pressing upward against the stop bar 22, urging it against the angle setting mechanism 40 which establishes the maximum upward angle of the stop bar 22. With no further "play" in the stop bar 22, as long as the hand is positioned around the club 12, the stop bar 22 thereby prevents the leading hand wrist 86 from moving. However, unexpectedly, with the leading arm 80, leading arm forearm 82, and leading arm wrist 86 prevented from movement, the trailing arm wrist 94 cannot bend either! Accordingly, the natural tendency to swing the club by the wrists is prevented. This can best be illustrated by viewing the arrangement between the golf club, the stop arm 22, and the leading arm forearm 82. As this arrangement essential fixes the pivotal position of the golf club 12 with respect to the leading arm 80 and locks the leading arm wrist 86, and since the trailing arm hand 92 is grasping the same golf club 12 in a contrary position, the leading arm 80 acts to prevent the trailing arm wrist 94 from bending as well.

Thus, by engaging the leading arm forearm 82 with the stop bar 22, the golfer 70 is forced to keep both his leading arm 80 and trailing arm 70 substantially in the positions shown in FIG. 7, and the golfer is forced to use his or her shoulders to swing the golf club 12. Accordingly, the golfer is prevented from incorrectly using his/her wrists to swing the club 12.

To ensure that the wrists are locked, the angle adjustment mechanism 40 is employed to ensure that the maximum upward angle is selective which is low enough to ensure that the user does not have sufficient wrist flexibility to pivot the club by the wrist at that maximum upward angle. Accordingly, such adjustment must be made according to the particular user, to accommodate the golfer's own degree of wrist flexibility.

In conclusion, herein is presented a system which attaches onto the grip of a golf club and engages the forearm of the leading arm to prevent both wrists from pivoting to swing the club. The system effectively trains a golfer to swing a golf club using his/her shoulders as opposed to pivoting the wrists. The invention is illustrated by example in the accompanying drawings figures. However, it should be appreciated that numerous variations are possible while adhering to the inventive concept. Such variations are contemplated as being a part of the present invention.

What is claimed is:

1. A golf training device, for training a golfer, having a leading arm having a leading arm wrist leading arm forearm having a leading arm forearm inner surface, the golfer also having a trailing arm having a trailing arm wrist, when using a golf club having a handgrip, to lock both the leading arm wrist and trailing arm wrist while swinging the golf club, comprising:

a sleeve, having a sleeve bore for extending over and attaching to the handgrip of the golf club with the handgrip extending through the sleeve bore, said sleeve further having a sleeve top and a sleeve bottom; and a stop arm, the stop arm being rigid and pivotally attached to the sleeve at a horizontal hinge axis near the sleeve bottom and capable of pivoting from nearly vertically upward at a high angle from the club to a downward position where the stop arm is substantially parallel to the club, the stop arm having a maximum upward angle, such that when the golf club is held by the golfer with the leading arm on the handgrip beneath the sleeve the forearm inner surface presses upward against the stop arm until the maximum upward angle is reached at which point the leading arm wrist is locked, thus preventing the golfer from pivoting the leading arm wrist to swing the golf club, wherein the maximum angle is adjustable with an angle adjustment mechanism located immediately above the hinge axis such that the maximum angle can be adjusted from a high angle to a low angle according to the user, the angle adjustment mechanism further comprising a set screw capable of retracting into the sleeve and extending outward from the sleeve such that when the set screw protrudes more from the sleeve, the maximum angle is decreased.

2. The golf training device as recited in claim 1, further comprising a tightening mechanism in communication with the sleeve bore; for allowing the sleeve to be tightened onto the golf club handgrip, to accommodate golf clubs having varying handgrip diameters.

3. The golf training device as recited in claim 2, wherein the leading arm forearm inner surface has leading arm forearm inner surface contours, and wherein the stop bar has a longitudinal concave hollow for accommodating the leading arm forearm inner surface contours comfortably within the longitudinal concave hollow.

4. The golf training device as recited in claim 3, wherein the stop arm has a pair of parallel side rails and a plurality of concave cross bars extending between the parallel side rails.

5. The golf training device as recited in claim 1, wherein the stop arm has a pair of parallel side rails, a pivot bar, a stop arm end opposite from the pivot bar, a contact bar extending between the side rails near the pivot bar, and a plurality of concave cross bars extending between the parallel side rails, and wherein the angle adjustment mechanism has a set screw located on the sleeve immediately above the hinge axis, and wherein the maximum upward angle is established by contacting the set screw with the contact bar.

6. A golf training method, for training a golfer, having a leading arm having a leading arm hand, a leading arm wrist, and a leading arm forearm having a leading arm forearm inner surface, the golfer also having a trailing arm having a trailing arm hand and a trailing arm wrist, using a device having a sleeve having a sleeve bore, a sleeve bottom, and a stop arm extending from and pivotally attached to the sleeve bottom at a hinge axis, said stop arm capable of pivoting between a maximum upward position and a lowered position where the sleeve is substantially parallel to the club, and an angle adjustment mechanism comprising a set screw located transversely on the sleeve just above the hinge axis, when using a golf club having a shaft and handgrip extending on the shaft, the handgrip having a handgrip top and a handgrip bottom, to lock both the leading arm wrist and trailing arm wrist while swinging the golf club, comprising the steps of:

attaching the device onto the golf club by extending the handgrip through the sleeve bore and securing the sleeve onto the handgrip between the handgrip top and handgrip bottom;

grasping the golf club with the leading hand beneath the sleeve and the leading arm forearm inner surface engaging the stop arm;

grasping the golf club with the trailing hand beneath the leading hand;

moving the stop arm to the maximum upward position with the leading arm forearm;

adjusting the maximum upward angle of the stop arm using the angle adjustment mechanism and retracting and extending the set screw from the sleeve; and preventing the leading arm wrist and trailing arm wrist from pivoting while attempting to swing the golf club by preventing the leading arm forearm from moving upward with the stop arm.

7. The golf training method as recited in claim 6 wherein the stop arm is has a longitudinal concave hollow, wherein the step of engaging the leading arm forearm inner surface further comprises accommodating the leading arm forearm inner surface within the longitudinal concave hollow.

8. The golf training method as recited in claim 7, further comprising the step of storing the training device by pivoting the stop arm downward so that the stop arm extends substantially parallel to the golf club shaft.

* * * * *